US006202622B1

(12) United States Patent
Raquiza, Jr.

(10) Patent No.: US 6,202,622 B1
(45) Date of Patent: Mar. 20, 2001

(54) CRANK SYSTEM FOR INTERNAL COMBUSTION ENGINE

(76) Inventor: Antonio C. Raquiza, Jr., #2351 Royal Crest Dr., Escondido, CA (US) 92025

( * ) Notice: Subject to any disclaimer, the term of this patent is extended or adjusted under 35 U.S.C. 154(b) by 0 days.

(21) Appl. No.: 09/177,986

(22) Filed: Oct. 22, 1998

(51) Int. Cl.[7] ..... F02B 75/32
(52) U.S. Cl. ..... 123/197.4
(58) Field of Search ..... 123/197.4, 197.3; 74/44, 567, 589, 590, 591

(56) References Cited

U.S. PATENT DOCUMENTS

| | | | | |
|---|---|---|---|---|
| 2,287,472 | * | 3/1942 | Eby | 77/44 |
| 2,353,285 | * | 4/1944 | Bell | 77/44 |
| 2,625,048 | * | 9/1953 | Vissat | 77/44 |
| 5,076,220 | * | 12/1991 | Evans et al. | 123/65 VC |
| 5,146,884 | * | 9/1992 | Merkel | 123/197.4 |
| 5,186,127 | * | 2/1993 | Cuatico | 123/53.1 |
| 5,394,839 | * | 3/1995 | Haneda | 123/53.1 |

* cited by examiner

*Primary Examiner*—Marguerite McMahon
*Assistant Examiner*—Jason Benton

(57) ABSTRACT

An crank system-device is hereby designed, specifically for piston-type internal combustion engines, to maximize the transfer of combustion power from the push-down pressure of the piston 10 to the twisting force of the crankshaft 15*b*. It provides for a "Downward Power Path" 18*b* that enables the piston 10 to push the crank pin 14 downwards and close to the piston centerline 16, unlike in the case of the "Sideways Power Path" 18*a* of the Prior Art wherein the piston 10 pushes the crank pin 14-1 sideways and away from the piston centerline 16. To effect a downward power path, an "Off-Center Crankshaft" 15*b* is resorted to, whereby the crankshaft is moved from its usual position along the piston centerline 16 to the left side thereof, and with an offset distance that places the downward path 18*b* of the crank pin 14 directly under the piston's downward axis along the piston centerline 16. A special "Variable-length Connecting Rod" 12, operating in conjunction with a "Multiple Crank Pin" 14 is herein also provided to suspend the TDC position of the piston 10 and to synchronize it with the new starting point for both the power stroke and the downward power path 18*b*.

2 Claims, 10 Drawing Sheets

Figure 1:
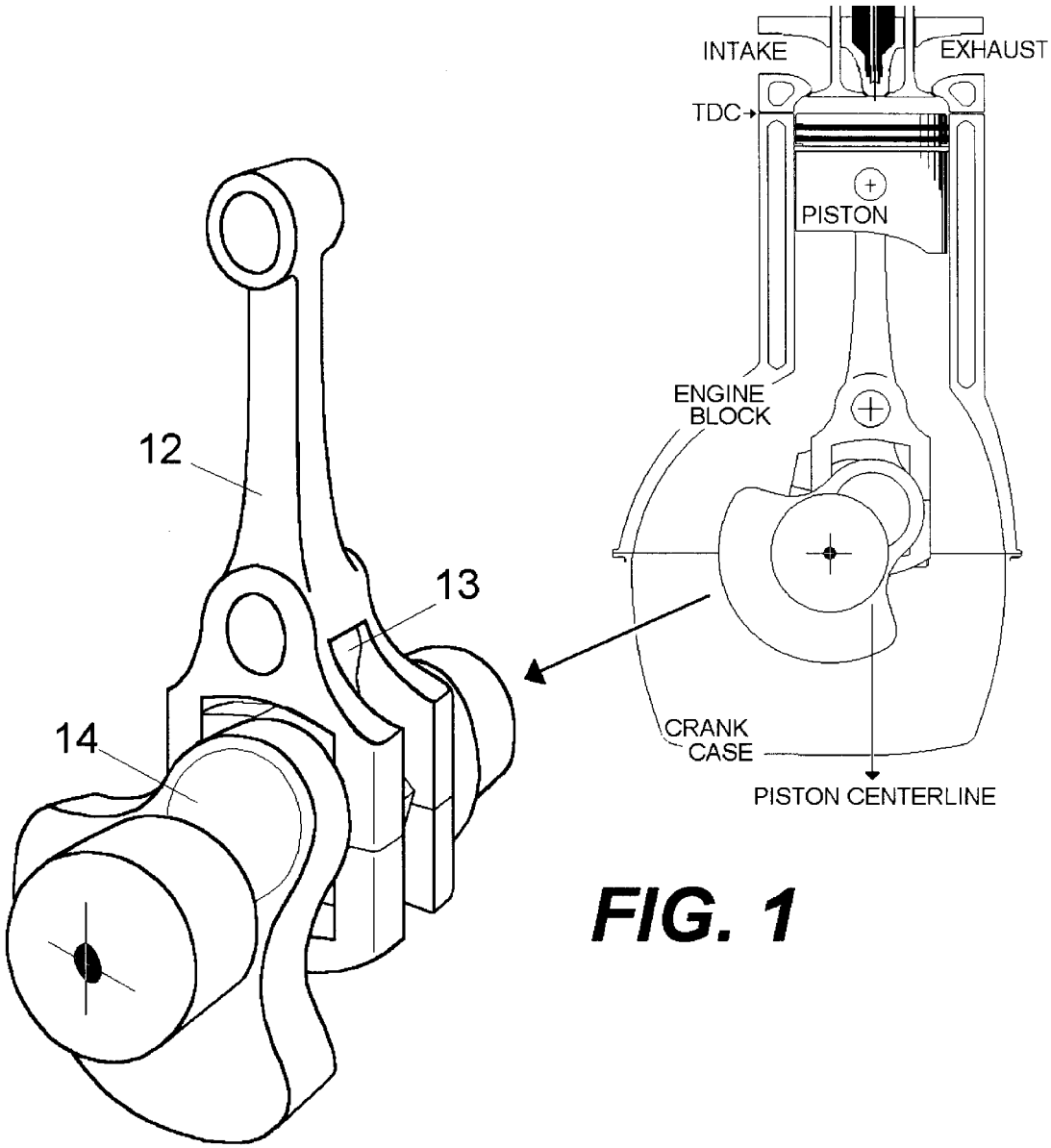

FIG. 3-A
(PRIOR ART)
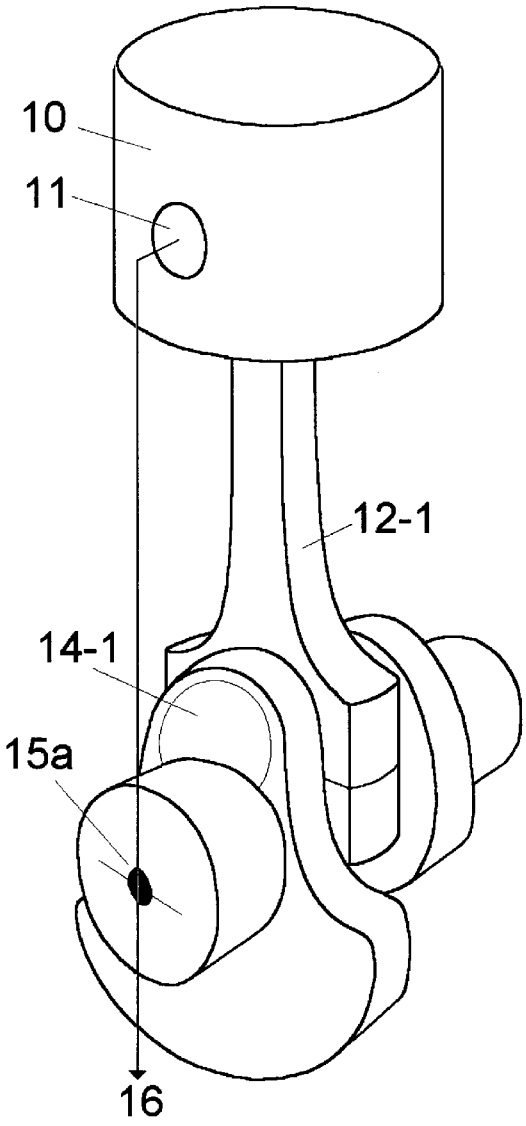
FIG. 3-B
(INVENTION)
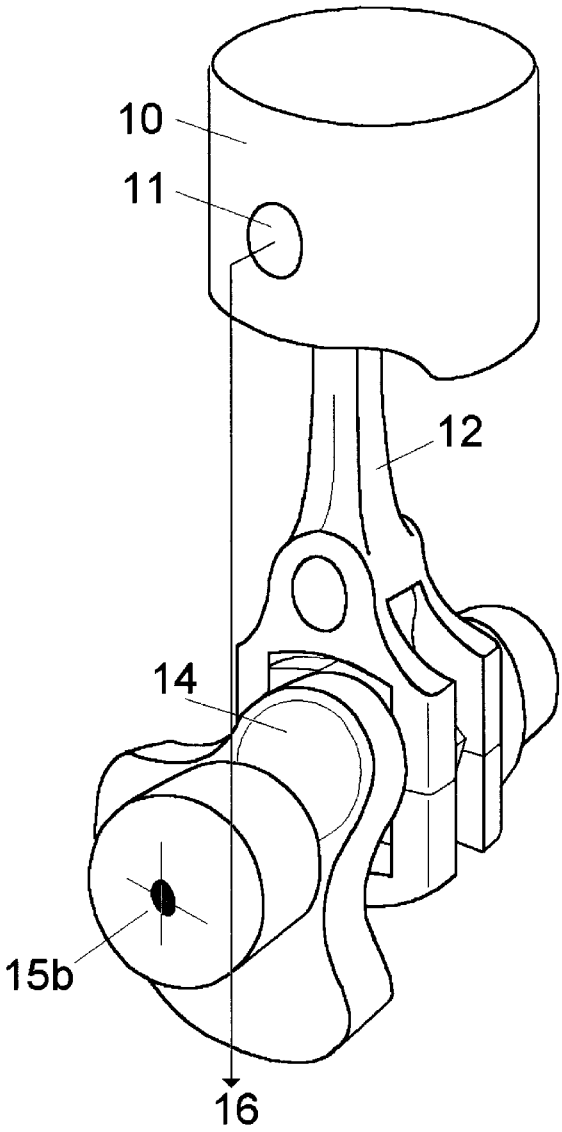

FIG. 4-A
(PRIOR ART)
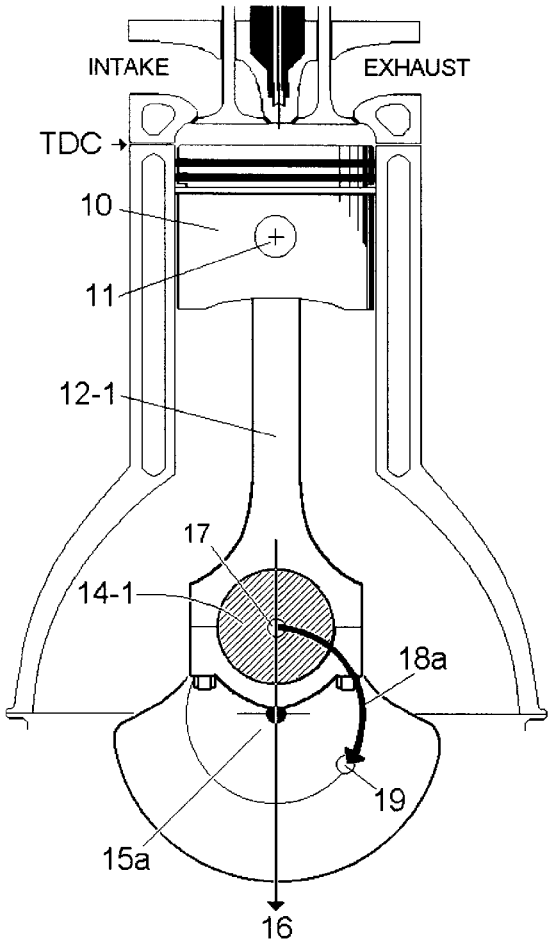
FIG. 4-B
(INVENTION)
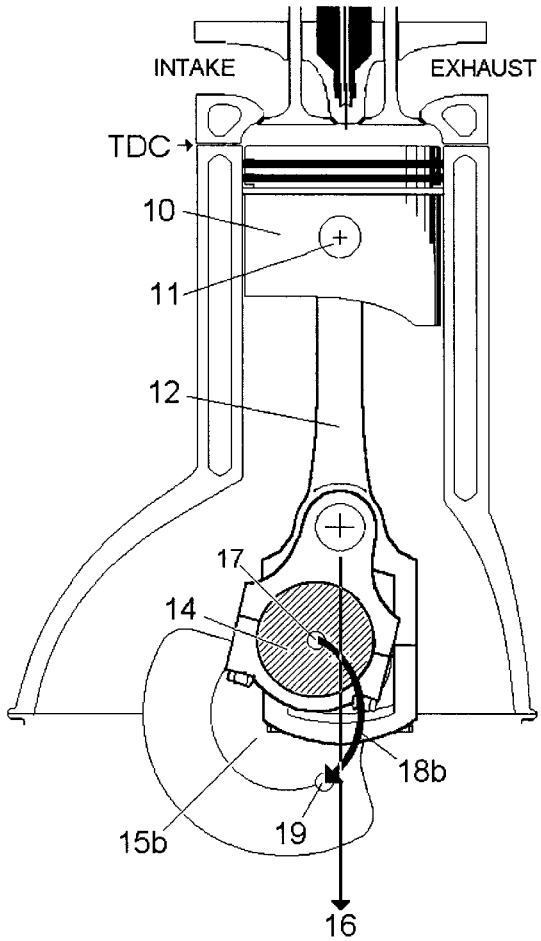

FIG. 5-A
(PRIOR ART)
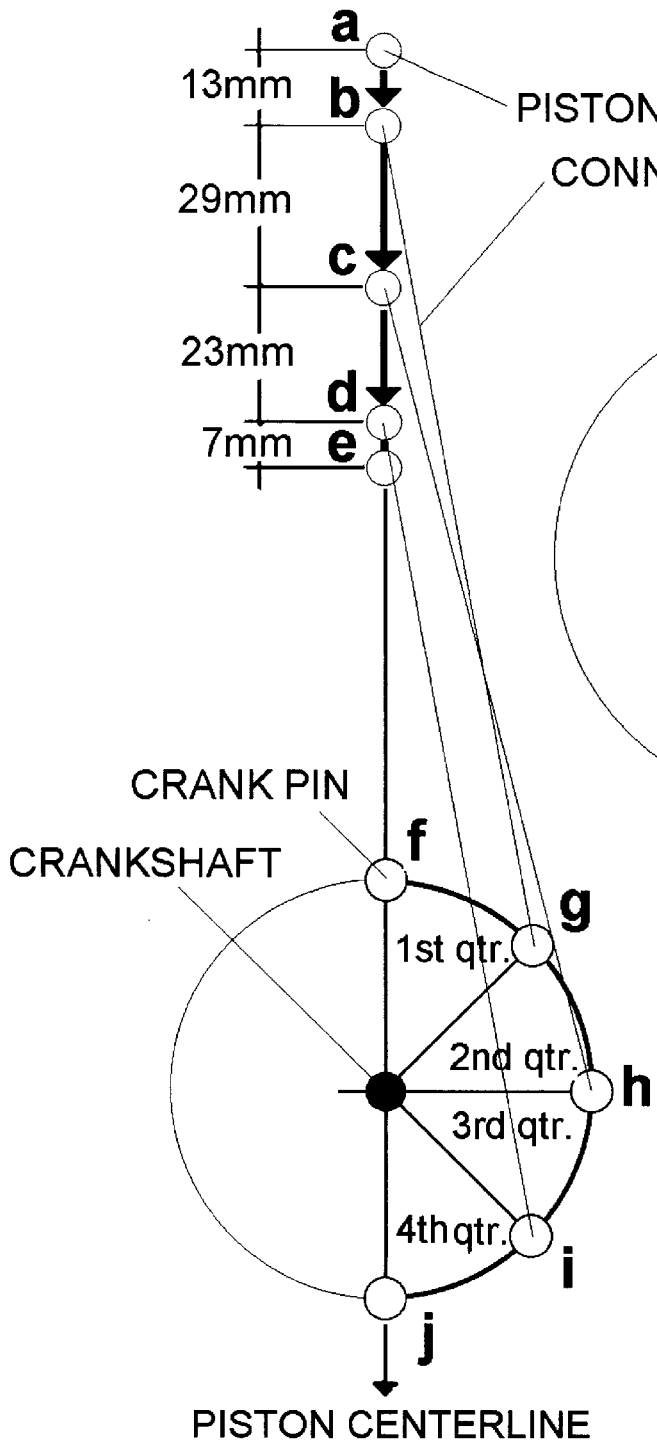
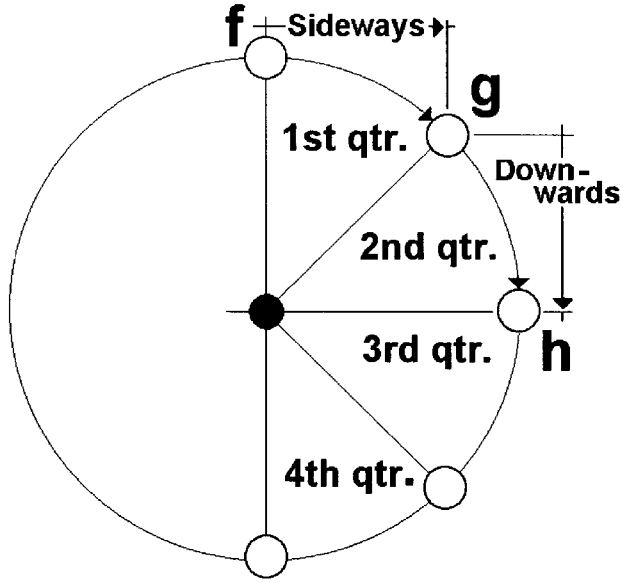
FIG. 5-B
(PRIOR ART)

FIG. 6
(PRIOR ART)
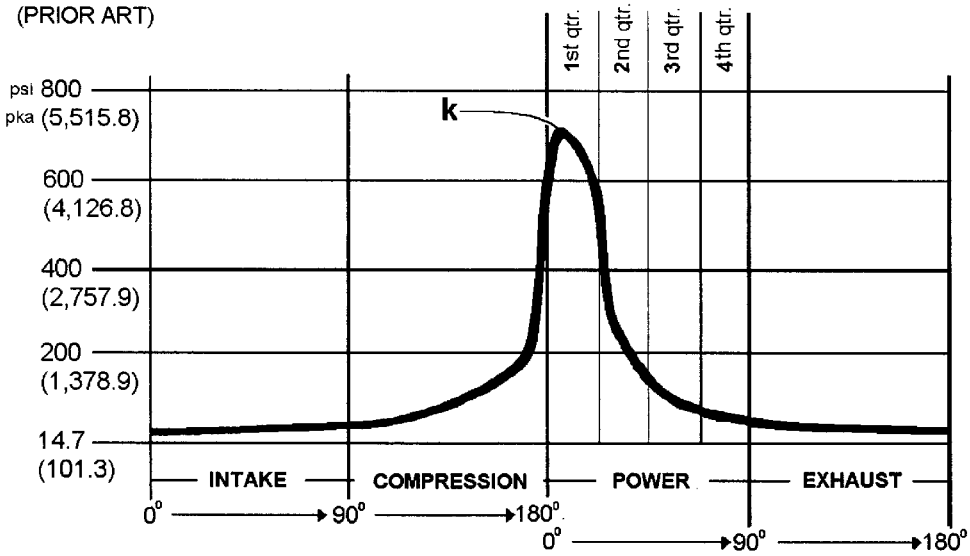
FIGS. 6-A 6-B 6-C 6-D 6-E
(PRIOR ART)
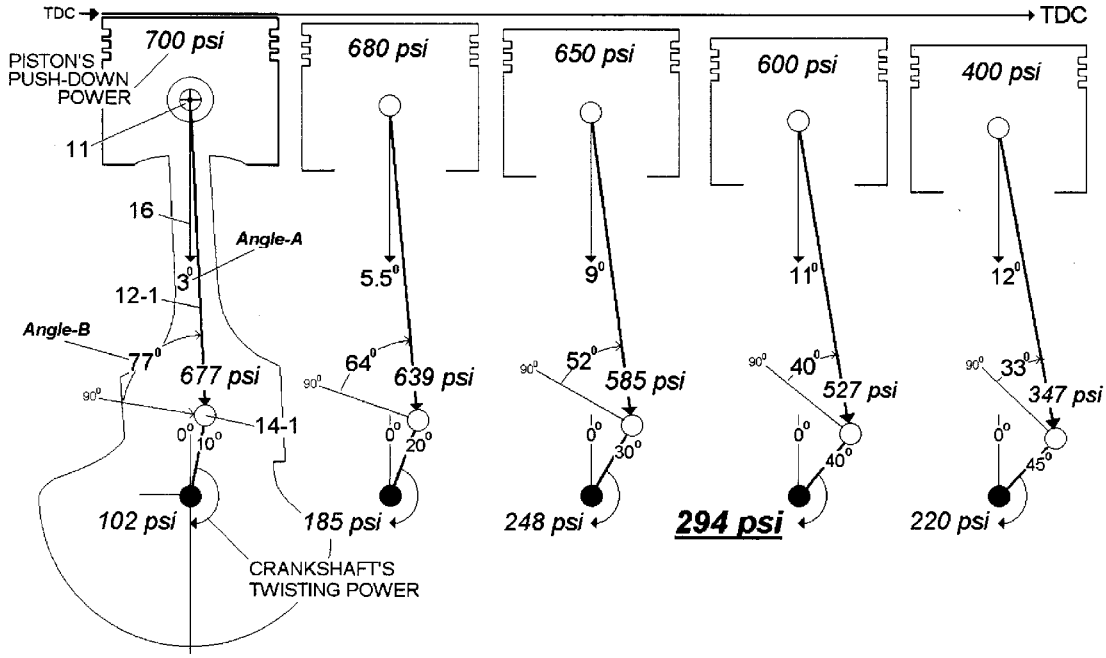

FIG. 7-A
(PRIOR ART)
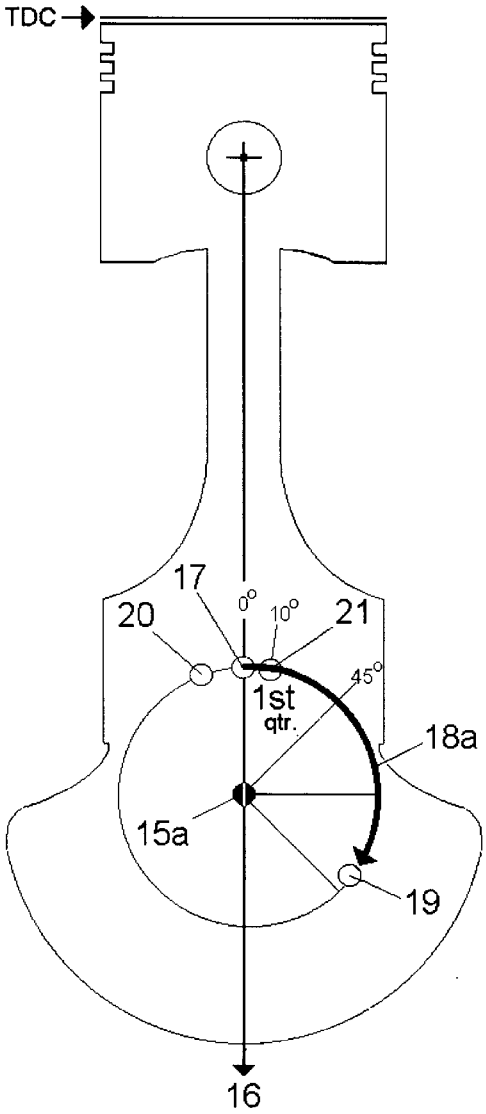
FIG. 7-B
(INVENTION)
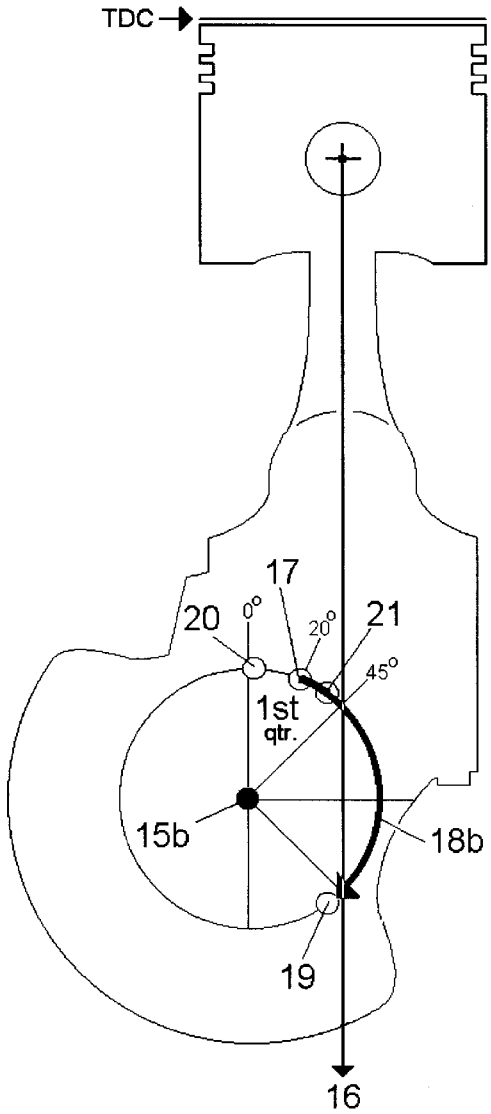

FIG. 9-A
(PRIOR ART with its fixed-lenght connecting rod)
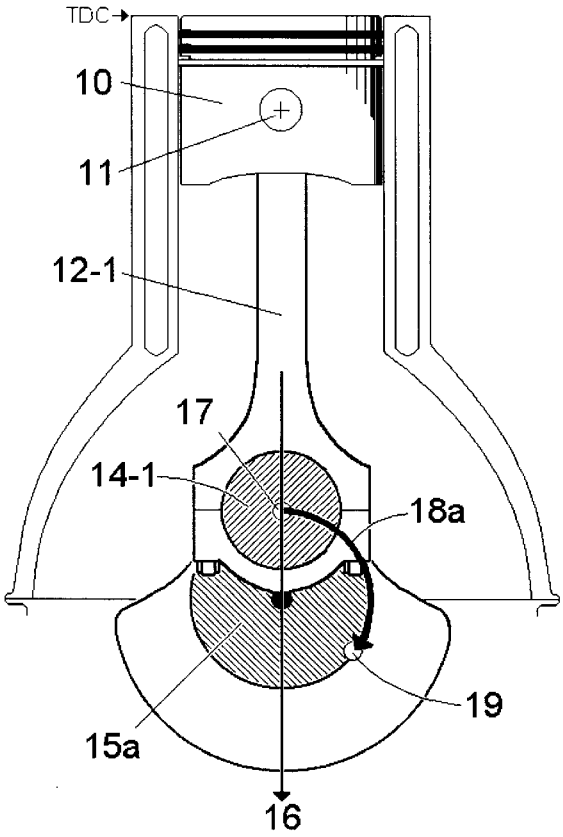
FIG. 9-B
(INVENTION using the prior fixed-lenght connecting rod)
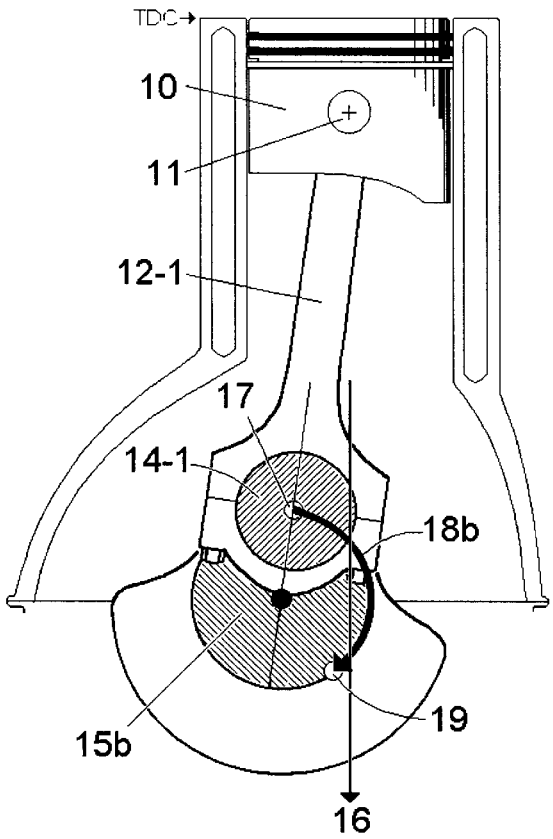

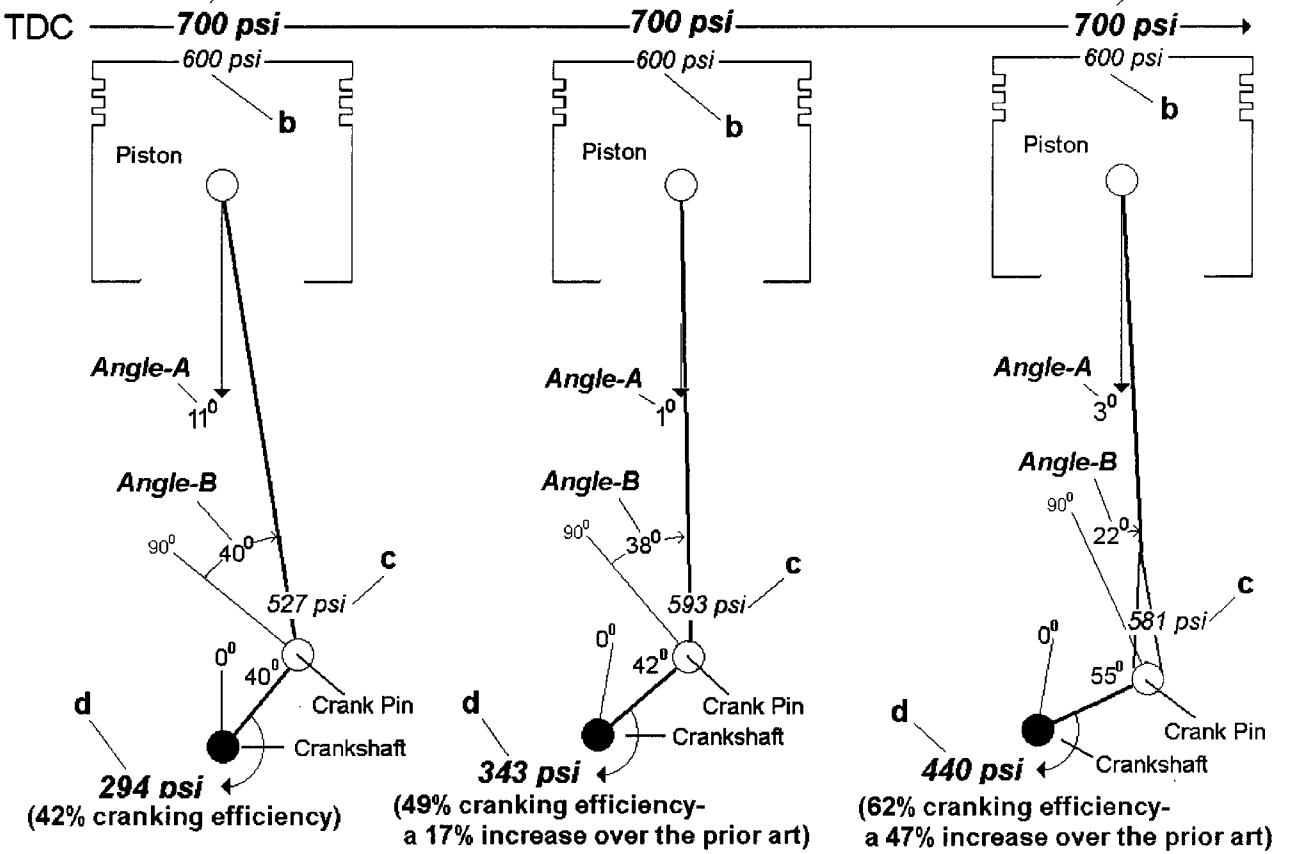
FIG. 10-A
(PRIOR ART- with its fixed-lenght connecting rod)
FIG. 10-B
(INVENTION using the prior fixed-lenght connecting rod)
FIG. 10-C
(INVENTION with its variable-lenght connecting rod)

CRANK SYSTEM FOR INTERNAL COMBUSTION ENGINE

BACKGROUND OF THE INVENTION

1. Field of Invention

The instant invention relates to a crank mechanism designed specifically for internal combustion engines to maximize the transfer of combustion power from the linear motion of the piston to the circular motion of the crankshaft.

2. Description of the Prior Art

Next to the wheel, the crank is the most significant motion-transmitting system-device used as a means of converting linear motion to circular motion, and vice-versa. The device involves a connecting rod acting on a crank pin to rotate a crankshaft. Its origin was traced back to China in 100 BC, and that the first connecting rod appeared in Europe in 830 AD. In other words, this prior and old crank system-device has been a part of public domain since the birth of mechanical science, patented to no one.

The crank is proven to have worked well in various applications, such as in pumps, jig saws, electric motors, and such other tools and equipment needing to convert the linear motion of one component into a circular motion of another component to effect a desired function. However, when applied to an internal combustion engine, this prior crank mechanism does not work well in transmitting combustion power from the linear motion of the piston to the circular motion of the crankshaft. Only a portion of original power is transmitted from the piston to the crankshaft due to certain mechanical limitations imposed by the crank itself in compliance with the engine's fuel-ignition system.

It is the function of the engine crank to convert heat energy into mechanical energy. During the power stroke, the explosion pushes down the piston to act on the crank pin and rotate the crankshaft. It is along the piston's downward axis, otherwise known as the Piston Centerline, that the push-down pressure of the piston is concentrated on. Unfortunately, under the prior art, the piston is not actually pushing the crank pin downwards along the piston centerline, but rather sideways and away from the piston centerline. The Lever Principle dictates that the farther away the crank pin is from the piston's downward axis where the force is concentrated, the lesser "push-down" pressure the piston exerts on the crank pin. Such is the case of the prior art. At the height of the explosion pressure, a substantial portion of the piston's push-down power cannot be transmitted downwards to the crankshaft because of the sideway travel of the crank pin to which the piston is mechanically linked through the connecting rod. It is a fact that only a mere 15%, or so, of the combustion power reaches the wheel to turn it. The downward tendency of most of the combustion pressure to push down the piston is hindered by the sideway travel of the crank pin to the far right, forcing the expanding hot gas to seek other avenues of escape through the cylinder walls, causing the bulk of the engine heat.

Thus, the term "Sideway Power Path" is hereby used to refer and describe the travel path of the crank pin during power stroke, starting from the piston centerline, moving sideways and away from the piston centerline. Such crank mechanism, as characterized in all internal combustion engines, has been the automotive industry's one and only standard for more than a century now. From the time a Belgian-French Etienne Lenoir invented the 2-stroke cycle internal combustion engine in 1857; as well as the 4-stroke cycle engine invented by yet another French engineer Alphonse Beau de Rochas in 1862; until a German engineer Nikolaus Otto successfully built the first 4-stroke cycle engine in 1876 using coal gas as fuel; up to the time Gottlieb Daimler and Carl Benz of Germany introduced their respective Horseless Carriages around 1885 using gasoline as fuel; followed by the introduction of the diesel engine in 1892 by another German Rudolph Diesel; until the time that American industrialist Henry Ford started mass-producing his affordable T-Model motor vehicles in 1908; and up to the time of this patent application (October, 1998), the prior and old crank mechanism used in all the aforesaid internal combustion engines (wherein the piston pushes the crank pin sideways and away from the piston centerline) has remained exactly the same . . . Unchanged.

SUMMARY OF THE INVENTION

Objects and Advantages

Accordingly, it is the object of the instant invention to do away with the shortcomings of the prior crank system (when applied to piston-type internal combustion engines) by providing a means for the piston to have more mechanical leverage in pushing down the crank pin to rotate the crankshaft.

As stated, it is the "Sideway Power Path" of the prior art, wherein the piston pushes the crank pin sideways and away from the piston centerline, that hinders the efficient transfer of combustion power from the piston to the crankshaft. Thus, the new crank system hereby provides for a "Downward Power Path", to replace the prior art's "Sideway Power Path", whereby, this time, the piston is able to push the crank pin downwards and close to the piston centerline. Such cranking alternative is in resonance with the Lever Principle that the closer the crank pin is to the piston's downward axis or piston centerline, the more push-down pressure the piston exerts on the crank pin, and thus increasing the twisting force of the crankshaft. In a layman's language, if you want to push down something, push it directly from above, not from the side, to maximize the transfer of power energy from the source to the receiving end.

Operation

Actually, both power paths (Sideway Power Path for the prior art, and Downward Power Path for the invention) are downward in nature because they start from the top (from zero-degree position of the crank pin, moving downwards until 120 degrees thereafter). For purposes of the instant invention, however, what makes a power path either sideways or downwards is its directional travel in relation to the piston centerline where the combustion power is concentrated on. Since the power path under the prior art starts from the piston centerline, moving sideways towards the right and away from the piston centerline, it is regarded as a "Sideway Power Path" in relation to the piston centerline. In the case of the invention, since the power path starts by crossing the piston centerline, moving downwards and close to the piston centerline, then crossing it back at the end of the power stroke, it is regarded as a "Downward Power Path" in relation to the piston centerline. Again, it is hereby emphasized that the "Piston Centerline" is "The" determining factor because it is along this line that the combustion power, through the push-down pressure of the piston, is concentrated on. Considering that the piston does not transmit power directly to the crankshaft but through the crank pin, the output twisting power of the crankshaft therefore depends on "how far" or "how close" the crank pin is to the piston centerline during the power stroke of the combustion cycle.

Following the foregoing line of reasoning, therefore, the only way to bring the power path closer to the piston centerline, is to reposition the crankshaft in relation to the piston centerline. From its prior and usual position along the piston centerline, the crankshaft is moved to the left side of the centerline, thereby also moving the power path of the crank pin to the left, and placing it directly under the piston's downward axis along the piston centerline. The heart of the new system, therefore, lies on an "off-center" position of the crankshaft in relation to the piston centerline which, not only brings the power path closer to or directly along the piston centerline, but also changes the nature of the crank pin's power path, from sideways to downwards. Thus, the term "Off-Center Crankshaft" is hereby used to described the position of the crankshaft away from the piston centerline (to the left side thereof, or right side as the case may be), as against the "Centerline Crankshaft" of the prior art wherein the crankshaft is collinear with the piston centerline. The Off-Center Crankshaft is an unprecedented cranking alternative, resulting in a "Downward Power Path" that enhances the conversion of the push-down power of the piston into a turning or twisting power of the crankshaft.

Consequently, the new "Downward Power Path" being introduced herein requires a delayed ignition timing to synchronize with the new starting point of said downward path which occurs some 20 degrees after the TDC (top-dead-center) position of the piston. Thus, a special connecting rod is also hereby provided and used to delay or suspend the TDC position of the piston for some 20-degree turn of the crank to synchronize it with the new ignition timing of the both the power stroke, as well as that of the Downward Power Path. This special connecting rod, herein called the "Variable-Length Connecting Rod" (as against the fixed-length connecting rod of the prior art), has one Small End and two Big Ends: the Rod Ankle and the Rod Guide (as against the one Small End and one Big End connecting rod of the prior art), operates in conjunction with a crank arm with "Multiple Rod Pins" to match and fit the rod ankle and the rod guide (as against the single rod pin of the prior art).

BRIEF DESCRIPTION OF DRAWING FIGURES

FIG. 1—A perspective view of a crank mechanism, subject of the instant invention, shown at TDC position of the piston.

Figure 2:
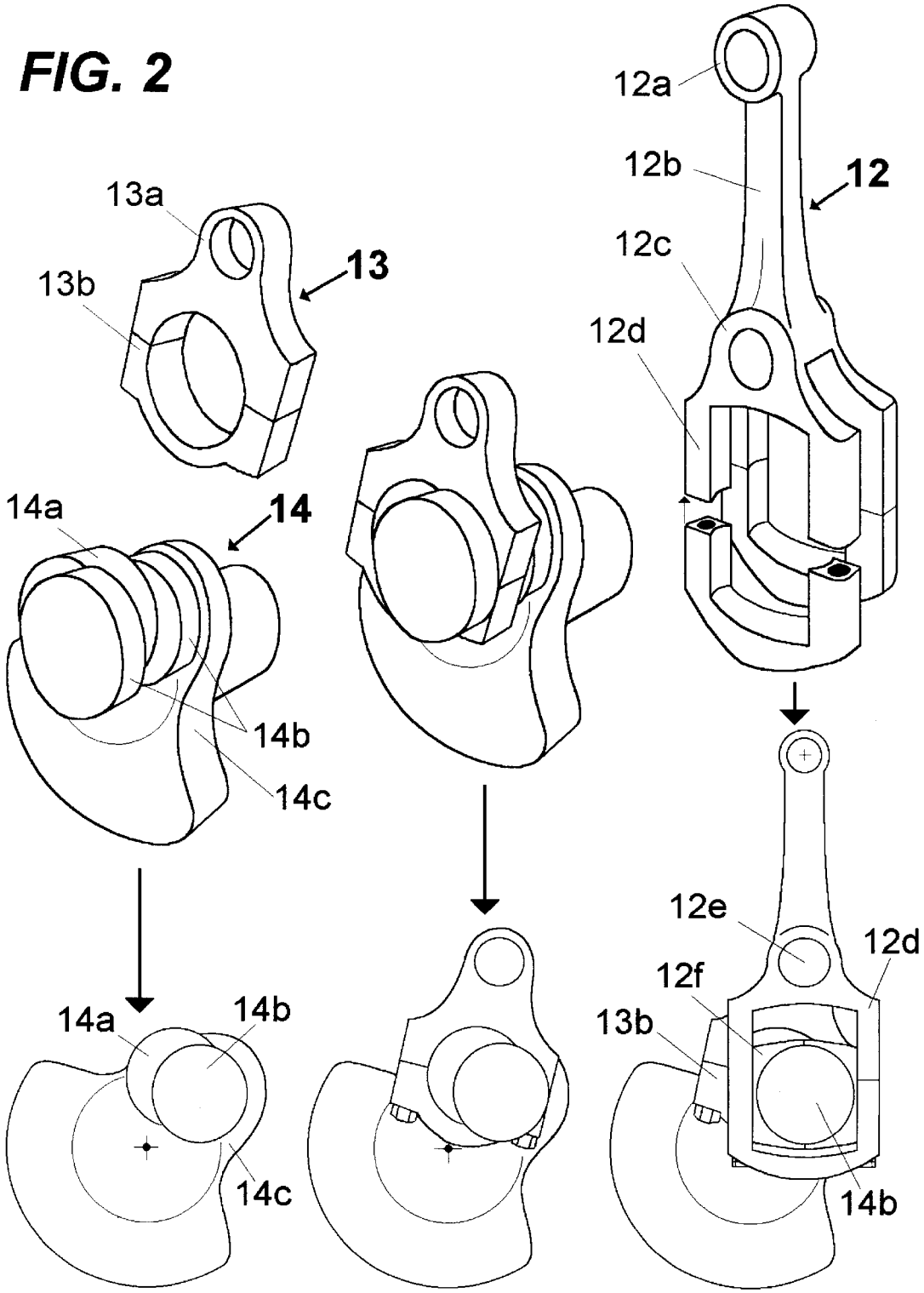

FIG. 2—A perspective view of the parts and components of the invention, together with a frontal view thereof.

FIG. 3-A and FIG. 3-B—A side-by-side visual comparison between the prior art and the invention.

FIG. 4-A and FIG. 4-B—A side-by-side comparative analysis on the respective operation of both the prior art and the invention.

FIG. 5-A, FIG. 5-B and FIG. 6—A three-figure illustrative backgrounders in fully understanding the inherent defect of the prior art.

FIGS. 6-A, 6-B, 6-C, 6-D and 6-E—A five-figure geometric and actual computations, illustrating the "poor cranking efficiency" of the prior art.

FIGS. 6-A, 6-B, 6-C, 6-D and 6-E—A five-figure geometric computation, illustrating the "improved cranking efficiency" of the instant invention in transmitting power from the piston to the crankshaft.

FIG. 7-A and FIG. 7-B—A side-by-side comparative analysis between the prior art's Sideway Power Path and the invention's Downward Power Path.

Figure 8:
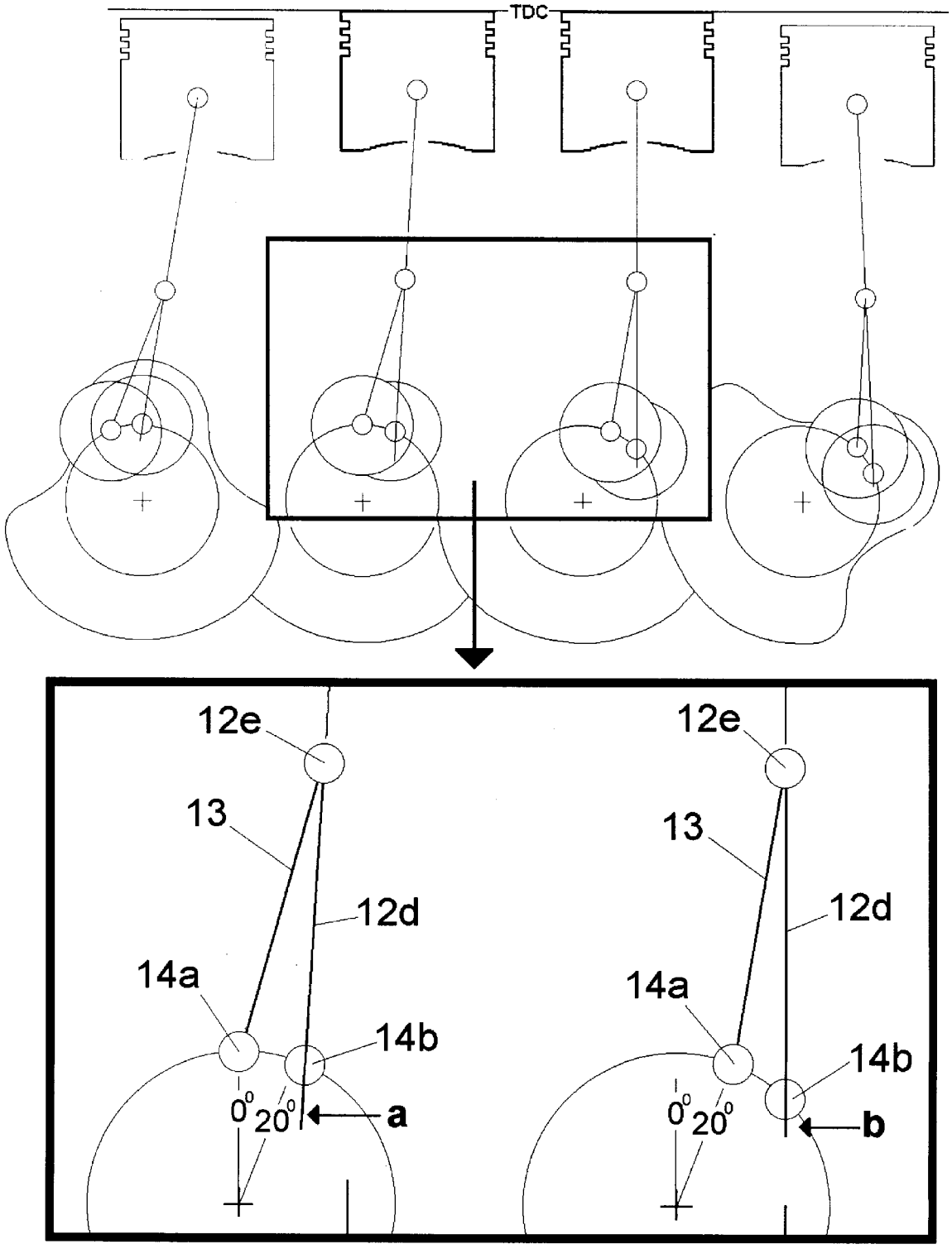

FIG. 8—An illustration, showing how the invention's variable-length connecting rod delays or suspends the TDC position of the piston.

FIG. 9-A and FIG. 9-B—A side-by-side visual illustration, showing that the invention may also use exactly the same fixed-length connecting rod of the prior art.

FIG. 10—A geometric and actual computation on the respective cranking efficiency of the prior art, the invention using the prior fixed-length connecting rod, and the invention using the variable-length connecting rod.

DRAWING NUMERALS:

10. Piston

11. Piston Pin

12-1. Fixed-length Connecting Rod

12. Variable-length Connecting Rod

12*a*. Small End of Variable Connecting Rod

12*b*. Stem of Variable-length Connecting Rod

12*c*. Center Joint of Variable Connecting Rod

12*d*. Rod Guide of Variable Connecting Rod

12*e*. Center Rod Pin for Variable Connecting Rod

12*f*. Bearing for the Rod Guide of the Variable-length Connecting Rod.

13. Rod Ankle of Variable-length Connecting Rod.

13*a*. Small End of Rod Ankle for the Center Joint.

13*b*. Big End of Rod Ankle

14. Multiple Rod Pin of the Crank

14*a*. Crank Pin for Rod Ankle of Variable-length Connecting Rod

14*b*. Split Crank Pin for the Rod Guide of the Variable-length Connecting Rod

14*c*. Crank Arm for the Multiple Crank Pin.

15*a*. Centerline Crankshaft for the prior art.

15*b*. Off-center Crankshaft for the invention.

16. Piston Centerline

17. Crank Pin position (at the start of power stroke)

18*a*. Sideway Power Path of Crank Pin (prior art)

18*b*. Downward Power Path of Crank Pin (invention)

19. Crank Pin position at the end of power stroke

20. Crank Pin position during Advance Ignition

21. Crank Pin position during Maximum Explosion Pressure

DETAILED DESCRIPTIONS OF DRAWING FIGURES

FIG. 1

This is a perspective view of a crank mechanism—subject of the instant invention, in its TDC (top-dead-center) position. The system-device involves a "Variable-length Connecting Rod 12, a Rod Ankle 13, and a Multiple Crank Pin 14.

FIG. 2

A perspective view of the parts and components of the invention, together with a frontal view thereof, showing how they are assembled. The Variable-length Connecting Rod 12 has one Small End 12*a*, and two Big Ends: the Rod Guide 12*d* and the Rod Ankle 13. The Rod Guide 12*d* is split to accommodate the Rod Ankle 13 in middle thereof, like a sandwich. The small end 13*a* of Rod Ankle 13 is held at the Center Rod Joint 12*c* by a Center Rod Pin 12*e*, allowing the Rod Ankle 13 to swing back-and-forth across the Rod Guide 12*d*.

On the other hand, the two Bid Ends (Rod Guide 12*d* and the Rod Ankle 13) of the Variable-length Connecting Rod 12 are attached to their respective Crank pins. The split Rod Guide 12*d* are attached to a split Crank Pin 14*b,* while the Rod Ankle is attached to a Crank Pin 14*a* in between the split Rod Guide 12*d.* The crank pins occupies the same circular axis around the crankshaft. But since there is an offset distance between the crank pins (14*a* and 14*b*), with the crank pin 14*b* for the Rod Guide being ahead of the crank pin 14*a* for the for the Rod Ankle 13*b* by some 16 mm (assuming that the stroke is 72 mm), a continuous revolution of the crank pins 14 around the crankshaft is the source of an eccentric motion that causes the Rod Ankle 13 to swing back and forth across the Rod Guide, like a pendulum, causing the connecting rod to extend and shorten, at a pre-determined time, to synchronize the TDC position of the piston 10 with the new ignition timing as required by the a Downward Power Path under the invention.

FIG. 3-A and FIG. 3-B

A side-by-side visual comparison between the prior art (FIG. 3-A) and the invention (FIG. 3-B). Aside from the big difference in physical appearance between the prior art's fixed-length connecting rod 12-1 and invention's variable-length connecting rod 12, it is also bared that, while the prior art's crankshaft 15*a* is aligned with the piston centerline 16, the invention's crankshaft 15*b* is offset to the left side of the centerline 16 by some 25 mm (assuming that the stroke is 72 mm). Thus, the term "Off-Center Crankshaft" 15*b,* the purpose of which is discussed in the next set of figures.

FIG. 4-A and FIG. 4-B

A side-by-side comparative analysis on the respective operation of both the prior art and the invention, as applied in a typical four-stroke internal combustion engine. The major difference between the two systems, as clearly shown in the drawings, is the position of their respective crankshaft 15 in relation to the piston centerline 16. While the crankshaft 15*a* of the prior art falls directly under the piston's downward axis along the piston centerline 16, the crankshaft 15*b* of the invention falls on the left side of the piston centerline 16, and with an offset distance that brings the power path 18*b* of the crank pin directly under the piston's downward axis along the piston centerline 16.

FIG. 4-A illustrates the operation of the prior art. The crankshaft 15*a* falls directly under the piston's downward axis along the piston centerline 16. The small end of the connecting rod 12-1 is attached to the piston pin 11, while the big end is attached to the crank pin 14-1. At the start of the power stroke at point 17, as shown in FIG. 4-A, the crank pin 14-1 is on top of its circular route at Zero-degree Position 17 along the piston center line 16. This raises the piston 10 to its highest level at TDC (top-dead-center), thereby pressing the fuel-mixture at its rated maximum compression ratio (of say 9.1.) ready for ignition. Notice that, at the start of the power stroke, the piston pin 10, the crank pin 14-1, and the Crankshaft 15*a* are all vertically aligned (collinear) along with the piston centerline 16. This is precisely the reason why, as the fuel mixture is ignited to explode, the piston 10 will necessarily has to start its downward travel by pushing the crank pin 14-1 sideways to the right and away from the piston centerline 16, ending at point 19 which is even farther away from the piston centerline 16. The foregoing features are indeed inherent in the prior art when applied to an internal combustion engine.

FIG. 4-B, on the other hand, illustrates the operation of the instant invention and how it differs from the prior art. Notice that the crankshaft 15*b* does not fall directly under the piston's downward axis or piston centerline 16, as in the case of the prior art, but is rather offset to the left side of the centerline (at a distance of say 25 mm, if based on a default setting of 72 mm for the length of the stroke). This offset distance places the downward travel path 18*b* of the crank pin 14 under the piston's downward axis along the piston centerline 16. At the start of the power stroke 17, the piston pin 10, the crank pin 13, and the crankshaft 15*a* are all also vertically aligned (collinear) like in the case of the prior art, but not along the piston centerline 16. At start of the power stroke, the crank pin 13 is position few degrees to the left of the piston centerline 16, so much so that when the fuel mixture is ignited to explode, the piston 10 starts its downward travel by pushing the crank pin 13 towards the piston centerline, crossing it at point a, proceeds downwards until it crosses back the piston centerline, then ends at point 19.

The foregoing presentation now clearly establishes the fact that the first structural difference between the prior art and the instant invention is the positional arrangement of their respective crankshaft (15*a* for the prior art, and 15*b* for the instant invention) in relation to a common piston centerline 15. The second structural difference between the two systems is their respective connecting rods: a fixed-length connecting rod 12-1 for the prior art, and a variable-length connecting rod 12 for the invention.

FIG. 5-A, FIG. 5-B and FIG. 6—A three-figure illustrative backgrounder in fully understanding the inherent defect of the prior art when applied to an internal combustion engine:

If we were to divide the power stroke into four stages or quarters, as shown in FIG. 5-A, it will show that the downward travel (from a to b) of the piston on the 1st Quarter is relatively slow (only 13 mm as compared to the 29 mm distance traveled on the 2nd Qtr., based on default setting of 72 mm for the length of the stroke) on account of the sideway travel (f to g) of the crank pin to which the piston 10 is mechanically linked through the connecting rod 12-1. It is only when the crank pin reaches the 2nd Qtr. of the power stroke (g to h) that the piston 10 gains its full downward momentum (b to c) at full speed on account of the downward travel (g to h) of the crank pin during said 2nd Qtr. Such speed continuous on to the 3rd Qtr. (h to i), then slows down again on the 4th Qtr. (i to j) as in the case of the 1st Qtr.

FIG. 5-B is a blow-up of the lower portion of FIG. 2-A to emphasize the sideway (f to g) and downward (g to h) travel path of the crank pin during the power stroke. Take note that it is exactly on point g, which is the 45-degree position of the crank pin, that crank pin's directional travel shifts from sideways to downwards.

FIG. 6 is a typical chamber pressure chart that appears in all books on internal combustion engines. It shows that the combustion power reaches its maximum explosion pressure early in the 1st Qtr. of the power stroke (at point k), at around 10 degrees ATDC (after top-dead-center), then subsides drastically on the 2nd Qtr. until right before the end of the 3rd Qtr. when all usable explosion pressures are gone.

A joint-implication of the above figures (FIG. 5-A, FIG. 5-B and FIG. 6) readily establishes the fact that—when the combustion power reaches its maximum explosion pressure k early in the 1st Qtr. of the power stroke (which is point 21 of FIG. 5-A), the expanding gas is held-back momentarily by the slow-moving piston (from a to b) on account of the sideway travel (from f to g) of the crank pin 14-1 to which the piston 10 is mechanically linked through the connecting rod 12-1. It is the momentary holding back of the expanding hot gas that combustion power is dissipated and lost to the engine walls, causing the bulk of engine heat. By the time the piston 10 assumes its full downward speed on the 2nd Qtr. (from a to b) on account of the downward travel (from g to h) of the crank pin 13, the explosion pressure shall have diminished considerably. By the end of the 3rd Qtr., all usable pressure are gone, so much so that the remaining 4th Qtr. (from i to j) is rather given away in favor of the Exhaust Stroke.

In other words, it is on the 1st Qtr. of the power stroke (from a to b) that the combustion power reaches it peak k to deliver the power kick to the flywheel that carries on the revolution of the crankshaft 15*a* until the next explosion, and yet it is during this very 1st Qrt. that the piston 10 is pushing the crank pin 14-1, not downwards, but rather sideways and away (from f to g) from the piston centerline 16. By the time the piston 10 starts pushing the crank pin 14-1 downwards on the 2nd Qtr. (from g to h), the explosion pressure shall have gone down considerably. To make things worst, the crank pin 14-1, which is supposed to be the recipient of the push-down pressure from the piston, is already past the centerline when the power is there, and yet it keeps on moving farther away from that centerline for the rest of the power stroke, receiving less and less power pressure from the piston.

FIGS. 6-A, 6-B, 6-C, 6-D and 6-E

A five-figure geometric and actual computations, illustrating the "poor cranking efficiency" of the prior art.

The following set of figures is relative to the prior art, showing how much of the original combustion power during the 1st Qtr. (or first 45-degree turn of the crank pin) reaches the crankshaft 15*a*. All numerical values and figures used herein are assumed and rounded-up for illustration purposes, such as the following: 72 mm for the stroke; 120 mm for the length of the connecting rod (from piston pin to crank pin); 700 psi for maximum explosion pressure, etc.

(NOTE: It is said that the power stroke commences when the piston is at TDC position when the fuel-mixture reaches its rated maximum compression ratio. But actually, the ignition of the fuel mixture occurs earlier than that, around 10 degrees BTDC (before top-dead center), which advances further as engine speed increases. The purpose is to give the fuel-mixture time to burn completely and reaches its maximum explosion pressure at the required point, between 10 to 15 degrees ATDC (after top-dead-center), for maximum brake torque (MBT).

In FIG. 6-A, advance timing occurs at 10 degrees BTDC (before top-dead-center), and that the maximum explosion pressure is reached at 10 degree ATDC (after top-dead-center). Let us first compute how much of that 700 psi is transmitted from the piston 10 to the crank pin 14-1, through the connecting rod 12-1. If only the connecting rod's downward direction is in line with the piston's downward axis, all that 700 psi would be transmitted to the crank pin 14-1. But in this case, since the connecting rod is 3 degrees off from the piston's downward axis, certain amount of power will have to be withheld. (Note: 3 degrees is 3.3% of the maximum 90-degree zero-power transmittal). Hence 3.3% of 700 psi (or 23 psi) will not be transmitted. It is only the remaining 677 psi that will reach the crank pin 14-1.

The next question is—how much of that 677 psi at the crank pin 14-1 will be transmitted to the crankshaft in terms of turning or twisting power? If only the connecting rod 12-1 is pushing the crank arm from a "Right Angle" or 90 degrees, all that 677 psi would be transmitted to the crankshaft 15*a*. But in this case, the connecting rod 12-1 is 77 degrees off the ideal 90-degree full power transmittal. Since 77 degrees is 86% of the 90-degree ideal angle, then 85% of the 677 psi at the crank pin (or 575 psi ) will not be transmitted. Only the remaining 102 psi will reach the crankshaft 15*a*.

In FIG. 6-B, the crank angle is set at 20-degree position of the crank pin 14-1, wherein the explosion pressure has gone down to 680 psi. Using the same manner of computation as in the case of FIG. 6-A, it would appear that, out that out of the 680 psi at the piston, only 639 psi thereof would reach the crank pin 14-1, until only 185 psi finally reaches the crankshaft 15*a*. Notice here that, although there is less combustion power to begin with, since there is less angle deviation from the ideal angles on both stages of the crank, more power would be from the piston 10 to the crank pin 14-1, and from the crank pin to the crankshaft 15*a*.

In FIG. 6-C, the crank angle is set at 30-degree position of the crank pin, wherein the explosion pressure has farther gone down to 650 psi. The crank pin receives 585 psi, and the crankshaft receives 248 psi.

In FIG. 6-D, where the crank angle is set at 40-degree position of the crank pin, and with a 600 psi power at the piston, the crank pin receives 527 psi, and the crankshaft finally gets 294 psi. Notice that, as the crank pin moves to the right, the less angle deviation from the ideal angle it does, so much so that, although there is a drop in the original combustion power at the piston level, the crankshaft would be receiving more power than earlier.

FIG. 6-E is set at the 45-degree position of the crank pin which is the end of the 1st Qtr. Notice that, since this point is the start of the downward travel of the crank pin, there is a sudden drop of power from 600 psi to 400 psi. The crank pin receives 347 psi, while the crankshaft gets 220 psi.

NOTE: From the foregoing five figures (FIGS. 6-A, 6-B, 6-C, 6-D and 6-E), it appears that it is when the crank angle is at the 40-degree position of the crank pin (FIG. 6-D) that the crankshaft 15*a* receives the greatest explosion power from the piston 10, which is 294 psi as shown in our example in FIG. 6-D. It offers less deviation from the ideal angles while the original power is still relatively high. It is this power 294 psi that would register in the flywheel to carry on the revolution until the next explosion cycle. Meaning, whatever power is left during the 2nd Qtr, until the end of the 3rd Qtr, merely helps the flywheel maintain the momentum of the 294 psi until the next explosion.

FIG. 7-A and FIG. 7-B

A side-by-side comparative analysis between the prior art's Sideway Power Path and the invention's Downward Power Path. This is a side-by-side illustrative comparison between the prior art and the instant invention, to show how the instant invention approaches the problem inherent in the prior art. In FIGS. 5-A, FIG. 5-B and FIG. 6, we have visualized that the defect of the prior art is "two fold", as follows:

First: At the height of the combustion pressure, the piston is pushing the crank pin sideways, slowing down the piston's downward travel, and thus tending to momentarily hold back the explosion. It is this particular mechanical restraint that forces the expanding hot gas to look for other avenues of escape by forcing their way out through the cylinder walls causing the bulk of the engine heat. Second: At the height of the combustion pressure which is concentrated along the piston's downward axis along the piston centerline, the crank pin is already past and still moving away from said piston centerline, thereby receiving the least push-down pressure from the piston.

In so far as the first defect is concerned, nothing much can be done to remedy the situation for such defect is, indeed, inherent in a mechanism that converts linear to circular motion. But in so far as the second defect is concerned wherein, at the height of the explosion pressure, the crank pin 14-1 is already past and still moving away from the piston centerline 16, here is where the instant invention comes into play.

As shown in FIG. 7-B, moving the crankshaft 15*b,* from its usual position along the piston centerline 16, to the left side thereof, would bring the downward path 18*b* of the crank pin directly under the piston's downward axis along the piston centerline 16. With this new and unprecedented positional arrangement of the cranking components, the crank pin 14*a* is just approaching and about to cross the piston centerline 16 when the explosion pressure reaches its peak 21, then proceeds to move downwards and close to the piston centerline 16 for the duration of the power stroke until point 19.

Having in mind that the maximum power 21 is concentrated along the piston's downward axis along the piston centerline 16, it is the proximity of the invention's power path 18*b* around the piston centerline 16, when the power is still there, that gives the invention the better mechanical advantage over the prior art. The invention's "Off-center Crankshaft" 15*b* would receive more push-down pressure from the piston 10 than that of the prior art's "Centerline Crankshaft" 15*a*. The invention's crank pin 14 is always close to where the action is, so to speak.

FIG. 8

An illustration, showing how the invention's Variable-length connecting rod 12 extends or suspends the TDC position of the piston. The connecting rod operates in conjunction with a "Multiple-Pin Crank" 14. The Connecting Rod 12, has one Small End 12*a* (attached to the piston pin 11), and two Big Ends—the Rod Ankle 13 and the Rod Guide 12*d*. The Crank arm 14*c* is fitted with multiple rod pins. Rod pin 14*a* is attached to the big end 13*b* of the rod ankle 13, while the rod pin 14*b* is attached to the split rod guide 12*d*. The Rod Ankle 13 and the Rod Guide 12*d* are placed side-by-side in a coaxial manner (with the rod ankle being sandwiched in the middle of the rod guide). They are attached to a common center rod pin 12*e*. This allows the rod ankle 13 to freely swing back and forth across the rod guide 12*d*.

If the rod ankle moves to the middle of the rod guide, it carries the effect of pushing up the entire connecting rod. As the rod ankle moves to the side of the rod guide, it carries the effect of pulling down the entire connecting rod. Since there is an offset-distance between the two rod pins, although on the same circular axis, the up-and-down retracting effect of the sliding connecting is activated by a change in the relative position of the multiple pin of the crank (14*a* and 14*b*) as they evolves along their common circular axis around the crankshaft 15*b*.

Concentrating now on the blown-up portion of FIG. 8, it is shown that as the crank pin 14*a* for the big end of the rod ankle 13*b* reaches the zero-degree position of the crank pin 14*a,* or there about, the piston 10 reaches its TDC position. For the next 20-degree turn, the connecting rod 12, of course, tends to go down. But because the rod ankle 13, which controls the length of the connecting rod 12, is made closer to the rod guide 12*d,* it tends to straighten up and pushes the entire connecting rod 12 upwards, thereby compensating for the descending effect of the crank's 20-degree turn. In other words, for a 20-degree duration, the piston 10 will neither go down, nor go up but will remain suspended and remain in that position during said 20-degree turn ATDC. This synchronizes the start of the power stroke 17 with the new downward travel path 18*b* of the invention which is also set at 20 degree ATDC. Notice how "a", which is the tail of the rod guide, shortens as the rod guide slides up as shown in "b".

FIG. 9-A and FIG. 9-B

A side-by-side visual illustration, showing that the invention may also use exactly the same Fixed-length connecting rod of the prior art. It looks like a "tilted crank" in an upright engine block. The cranking components are the same as that of the prior art, except the "off-center" position of the crankshaft 15*b* in relation to the piston centerline 16, which brings the power path 18*b* (referring to the downward travel path of the crank pin 14 during the power stroke) directly under the piston's downward axis along the piston centerline 16. The Downward Power Path 18*b* begins from point 17, crosses the piston center line 16, moves downwards until it crosses back the piston centerline, ending a point 19.

As will be shown in the next drawing figure (FIG. 10), the invention using the prior art's fixed-length connecting rod 12-1 would results in an impressive 17% increase in cranking efficiency over the prior art, while the same invention using the new variable-length connecting rod 12 would result in a stunning 47% increase in cranking efficiency over the prior art.

FIG. 10

A geometric and actual computation on the respective cranking efficiency of the prior art, the invention using the prior Fixed-length connecting rod 12-1, and the same invention using the Variable-length connecting rod 12.

To begin with, it is first most significant to note here that the push-down power of the piston is not directly transmitted to the crankshaft, but through the crank pin. The crank mechanism goes through two angle deviations, namely: Angle-A which is the angle of the connecting rod 12 in relation to the piston centerline 16, and Angle-B which is the angle of the connecting rod in relation to the crank arm 14*c*. These angle deviations controls the amount of combustion power that goes through the crank from the piston 10 to the crank pin (Angle-A), and from the crank pin 14 to the crankshaft (Angle-B).

Let us now take the case of the prior art, as shown in FIG. 10-A., wherein the crank angle is set at the 40-degree position of the crank pin 14-1 which, as earlier discussed, is the most ideal angle because it is in this crank angle position that the crankshaft receives the greatest amount of power from the piston 10 through the crank pin 14-1. In our example (FIG. 10-A), the power available at the 40 degree position is 600 psi a. This power goes through Angle-A where there is an angle deviation of 11 degrees from the ideal zero-degree angle in relation to the piston centerline 16. Since 11 degrees is 12.2% of the maximum 90-degree zero power transmission, then 12.2% of the 600 psi will not be transmitted. Only the remaining 527 psi will reached the crank pin. Then comes Angle-B where there is deviation of 40 degrees from the ideal 90-degree full power transmittal. Since Angle B is 40 degrees, which is 44.4% of the 90-degree ideal angle, then 44.4% of the 527 psi at the crank pin will not be transmitted. Only the remaining 294 psi will reaches the crankshaft in terms of twisting power.

From the foregoing computations, it now appears that the cranking efficiency of the prior art is only 42%. Meaning, only 42% of whatever combustion power is generated above the piston, which in this case was originally 700 psi, reaches the crankshaft in terms of twisting power.

In FIG. 10-B, it appears that the invention using the prior art's fixed-length connecting rod 12-1 would deliver a twisting power of 343 psi to the crankshaft out of the original 700 psi combustion power. This raises cranking efficiency to 49% which is a 17% increase over that of the prior art.

In FIG. 10-C, it is confirmed that the invention using the new variable-length connecting rod 12 would deliver a twisting power of 440 psi to the crankshaft out of the original 700 psi combustion power. Cranking efficiency is a stunning 62%, which is a 47% increase over that of the prior art.

CONCLUSION, RAMIFICATION AND SCOPE OF THE INVENTION

As could be deduced from the foregoing presentation, it is the provision for an "Off-Center Crankshaft" 15*b* by the new crank system that is what the instant invention is all about, and with the end view of replacing the "Centerline Crankshaft" of the prior art 15*a*. An of-center crankshaft results in a "Downward Power Path" 18*b* that enables the piston 10 to push the crank pin 14 downwards and close to the piston centerline 16, unlike in the case of the "Sideways Power Path" 18*a* of the prior art wherein the piston 10 pushes the crank pin 14-1 sideways and away from the piston centerline 16.

In so far as the mechanical implementation of the new crank system is concerned, there are two ways of doing it. It may done either, through the use of the usual and prior connecting rod (having one Small End and one Big End) that gains an impressive a 17% increase in cranking efficiency over the prior art; or through the use of a special-sliding connecting rod (having one Small End and two Big Ends) wherein the increase in cranking efficiency reaches a stunning figure of 47%. The invention's newly-gained mechanical advantage of pushing the crank pin downwards and close to the piston's downward axis along the piston centerline greatly enhances the transfer of combustion power from the piston to the crankshaft, resulting in an unprecedented increase in the crankshaft's twisting power, known as "torque power", which is the raw source of the engine's output power called "horsepower".

How much more power is achieved? Theoretically speaking, since all the power-grabbing factors of the engine have already taken their toll from the usual combustion powers generated under the prior art, any added power gained through the instant invention would therefore go directly to the wheel, or to be added to the 15% already allotted to the wheel by the prior art as confirmed in any and all books on internal combustion engines. In other words, the invention, using either the usual and prior fixed-length connecting or the special variable-length connecting rod, practically doubles or triples, respectively, the driving power of the vehicle or any other piston-driven equipment as the case may be. More power simply means more mileage per gallon of gas, either through increased gearing ratios, or reduced fuel displacement or cylinder size.

In so far as the scope of the instant invention is concerned, it will be understood that, while certain novel features of the instant invention have been shown, described and pointed out in the annexed claims, it is not intended to be limited to the details above, since various omissions, modifications, substitution and changes in the form and details of the device illustrated and in its operation can be made by those skilled in the art without departing in any way from the spirit of the instant invention, more particularly the working principles involved in the new and unprecedented crank mechanism being introduced through herein patent application. Although the description above contains many specifications, these should not be construed as limiting the scope of the invention but as merely providing illustrations of some of the presently preferred embodiments of this invention.

What is claimed as new and desired to be protected by Letter Patent is as follows:

1. A crank system-device for piston-type internal combustion engine, consisting of a connecting rod and a crankshaft, with the following features:

(a) The small end of the connecting rod is attached to the piston pin, white the big end of said connecting rod is attached to the crank pin, the up and down motion of the piston results in a rotating motion of the crankshaft, (b) The crankshaft is placed on the left side of the piston centerline, whereby the downward path of the crank pin, at the start of the power stroke, begins from the left side of the piston centerline, moving down to the right and crosses the piston centerline when the crank is at a 45-degree angle.

2. A crank system-device, as in claim 1, whereby the downward path of the crank pin, at the end of the power stroke, moves down to the left and crosses the piston centerline when the crank is at a 135-degree angle.

* * * * *

UNITED STATES PATENT AND TRADEMARK OFFICE

CERTIFICATE OF CORRECTION

PATENT NO. : 6,202,622 B1
DATED : March 20, 2001
INVENTOR(S) : Raquiza, Jr.

It is certified that error appears in the above-identified patent and that said Letters Patent is hereby corrected as shown below:

Column 12,
Line 34, after the word "pin" delete the -- , --.

Signed and Sealed this

First Day of April, 2003

JAMES E. ROGAN
*Director of the United States Patent and Trademark Office*